US007588500B2

(12) United States Patent
Hoeckl et al.

(10) Patent No.: US 7,588,500 B2
(45) Date of Patent: Sep. 15, 2009

(54) GOLF CLUB SWING WEIGHT

(76) Inventors: Frank J. Hoeckl, 13790 Sterling Oaks Dr., Sterling Heights, MI (US) 48313; Walter J. Hoeckl, 13328 Mair, Sterling Heights, MI (US) 48313

( * ) Notice: Subject to any disclaimer, the term of this patent is extended or adjusted under 35 U.S.C. 154(b) by 0 days.

(21) Appl. No.: 12/022,671

(22) Filed: Jan. 30, 2008

(65) Prior Publication Data

US 2009/0191978 A1 Jul. 30, 2009

(51) Int. Cl.
*A63B 69/36* (2006.01)

(52) U.S. Cl. ..... 473/256; 473/226; 473/437

(58) Field of Classification Search ..... 473/219, 473/226, 228, 256, 437, 457; 482/92, 105; 273/DIG. 30

See application file for complete search history.

(56) References Cited

U.S. PATENT DOCUMENTS 4,142,721 A * 3/1979 Faleck et al. ..... 473/437
4,535,987 A * 8/1985 Dikoff ..... 473/406
4,588,191 A * 5/1986 Stewart ..... 473/256
5,226,647 A * 7/1993 Notarmuzi ..... 473/284
D355,229 S * 2/1995 Mugnolo ..... D21/683
5,484,156 A * 1/1996 Giguere ..... 473/256
5,672,150 A * 9/1997 Cox ..... 602/21
7,169,069 B1 * 1/2007 Dalton et al. ..... 473/568
2005/0050696 A1 * 3/2005 Essick ..... 24/306
2007/0021228 A1 * 1/2007 Flood ..... 473/226

* cited by examiner

*Primary Examiner*—Nini Legesse
(74) *Attorney, Agent, or Firm*—Harness, Dickey & Pierce, P.L.C.

(57) ABSTRACT

A golf club swing weight apparatus. The apparatus has a first weight and a second weight each having a pair of apertures formed therein, and adapted to be secured against a club shaft of a golf club. A strap having a length sufficient to extend through the pairs of apertures, and around the first and second weights when the first and second weights are positioned adjacent one another on said club shaft, is used to secure the first and second weights to the club shaft. The strap may include a loop element affixed to a first end thereof, and a first hook and loop type fastener material at the first end. A second end of the strap may include a stop component fixedly secured to the strap. The stop prevents the second end from being completely pulled through said loop element. Thus, the weights may not be inadvertently separated from the strap while the apparatus is affixed to a club shaft and an individual is swinging the golf club. The hook and loop type fastener materials enable the weights to be quickly and easily secured to (and removed from) the club shaft without the need for any external tools or complex procedures.

20 Claims, 3 Drawing Sheets

FIG 1
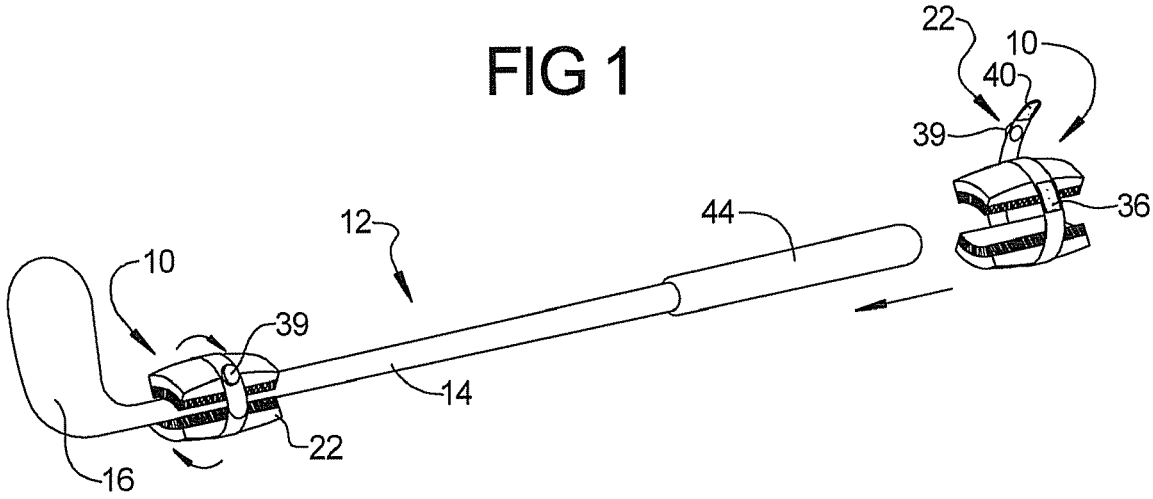
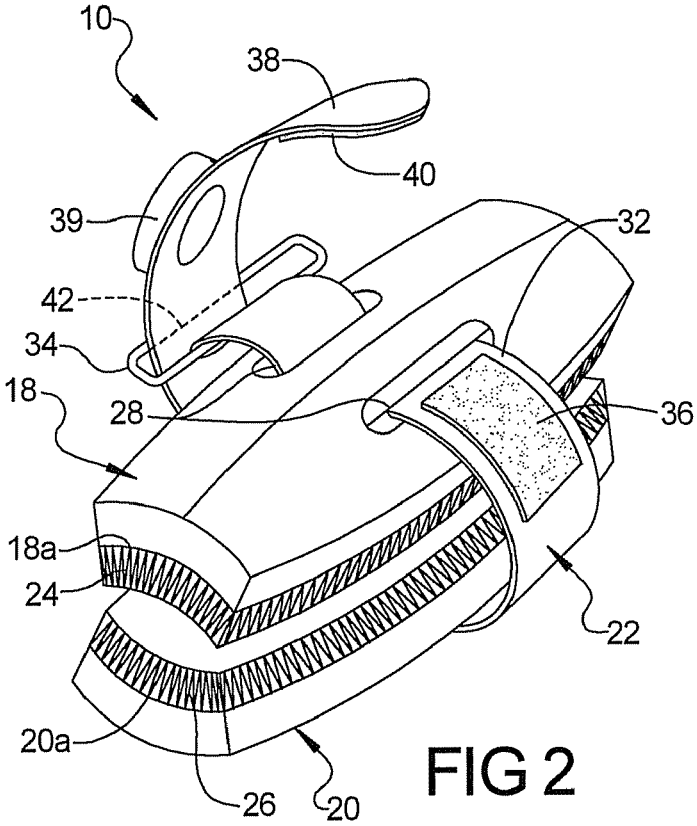
FIG 2

FIG 3
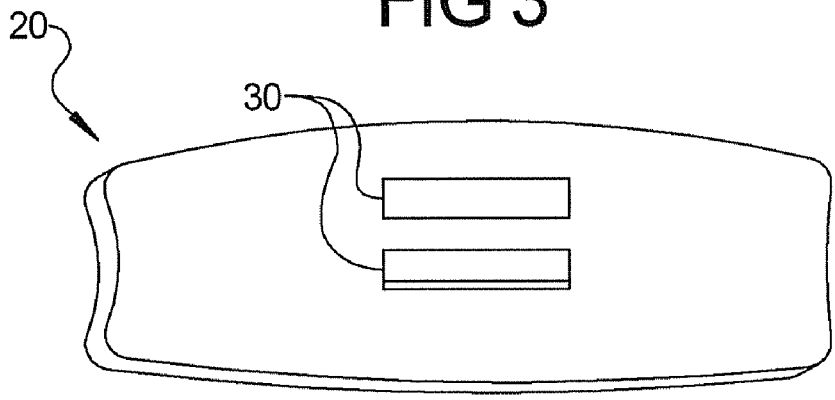
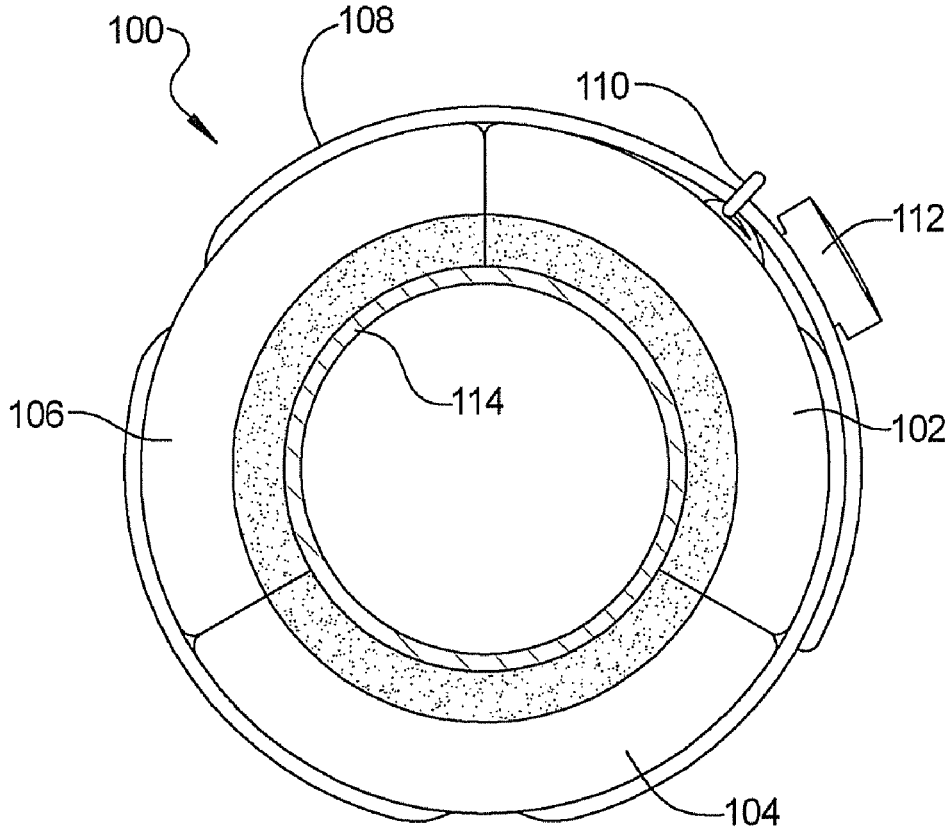
FIG 4

FIG 5
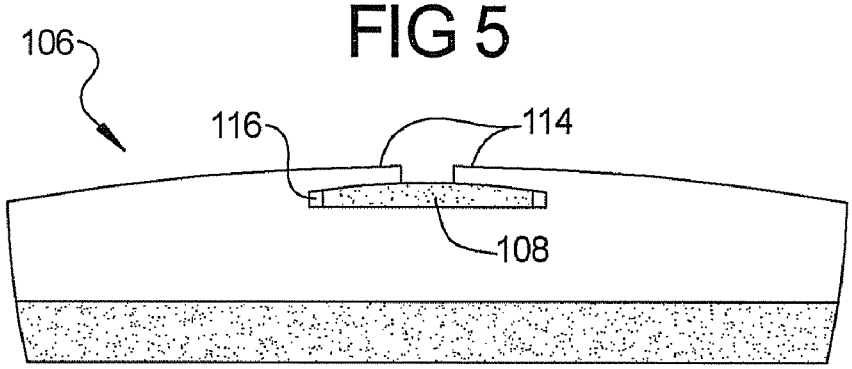
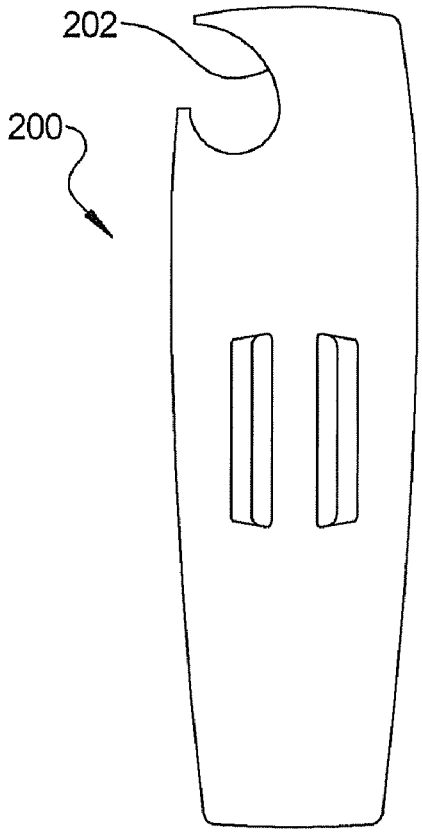
FIG 6

GOLF CLUB SWING WEIGHT

FIELD

The present disclosure relates to golf club weight systems that may be used to increase the club head weight of a golf club for practice purposes, and more particularly to a golf club swing weight apparatus that is quickly and easily attachable to a shaft of a golf club, and that is secured in such a manner that it is virtually impossible for the apparatus to come loose from the club shaft during swinging of the golf club

BACKGROUND

The statements in this section merely provide background information related to the present disclosure and may not constitute prior art.

Golf club swing weights have been used to provide additional weight to the club head of a golf club during golf practice sessions, such as when taking practice swings with a golf club, or even when hitting golf balls at a driving range. The additional weight helps to strengthen the golfer's grip, and arm muscles, in addition to enhancing overall swing mechanics.

Typically golf club swing weights have employed some form of weight that is removably secured to the club shaft closely adjacent to the club head. However, with many previously developed swing weights, attaching and/or removing the weight may require external tools, for example screwdrivers, pliers, etc. Thus, many are often cumbersome to attach and/or remove from the golf club.

Other forms of golf club swing weights may be secured in ways that are less than optimal, from a safety standpoint. Still other forms of swing weights do not allow for the adjustment of the amount of weight employed. More specifically, they do not enable additional weights to be easily added so that the amount of weight used can be ideally suited to the strength of the individual. This is a particular drawback when the same swing weight is used by a small female golfer and a large male. The ideal weight, for practice purposes, for the female golfer may be considerably less than for the male. However, many swing weight devices do not allow for the addition or removal of individual weights so that the device can be tailored for individuals of widely varying strengths.

Still other forms of previously developed swing weights are of relatively complex and costly construction, or may be somewhat bulky and not easily stored in a golf bag.

Thus, a number of drawbacks exist with presently available swing weights.

SUMMARY

The present disclosure is directed to a golf club swing weight apparatus. The apparatus includes a weight having an aperture formed therein. A strap is provided that has a length sufficient to extend through the aperture, around the weight, and around a club shaft so that the strap secures the weight to the club shaft. The strap includes a loop portion affixed to a first end thereof, and a first hook and loop type fastener material at the first end. A second end of the strap includes a stop component fixedly secured to the strap such that the stop component prevents the second end from being completely pulled through the loop. The second end also includes a second hook and loop type fastener material that is engageable with the first hook and loop type fastener material. When the strap is wrapped around the weight and the club shaft, and the first and second hook and loop type fastener materials are engaged, the weight is securely held to the club shaft. The stop and the loop prevent the weight and the strap from being inadvertently released from the club shaft while swinging the golf club.

In one embodiment the apparatus includes a pair of weights that each has a pair of apertures. The strap extends through the apertures of each weight and secures the weights against the club shaft.

In another embodiment first, second and third weights are included. The strap extends through apertures in each of the first, second and third weights to secure the weights to the club shaft.

In another embodiment a plurality of weights are employed, with one of the weights having a narrow slot formed by a pair of tongue portions. The strap can be easily manipulated into and out of the slot, but the tongue portions prevent the weight from being released from the strap and the club shaft during swinging of the golf club.

In the various embodiments the stop component positively prevents the second end of the strap from inadvertently opening and allowing the weights to be separated from the strap during swinging of the golf club. The apparatus can be quickly and easily secured to, and removed from, the club shaft of a golf club with no external tools, and without complex assembly/disassembly procedures. The ability to accommodate more than one weight enables the apparatus to be tailored to provide varying amounts of weight as might be needed by golfers of different sizes and strengths. Since the apparatus is compact, it can also be easily stored in a golf bag.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

FIG. 1 is a perspective view of one embodiment of the apparatus secured to a club shaft of a golf club adjacent the head of the golf club;

FIG. 2 is an enlarged perspective view of the apparatus of FIG. 1;

FIG. 3 is a perspective view of just the second weight showing the pair of apertures formed therein;

FIG. 4 is an end view showing an embodiment of the apparatus that makes use of three independent weights secured by the strap around the club shaft of the golf club; and FIG. 5 is a side view of another embodiment of a weight that may be used with the apparatus, where the weight includes a narrow slot formed by a pair of tongue portions, and where the slot may be used to receive the strap;

FIG. 6 is a plan view of another embodiment of a weight that may be used with the apparatus, where the weight includes a cutout for enabling the weight to also function as a bottom cap removal tool.

DETAILED DESCRIPTION

The following description is merely exemplary in nature and is not intended to limit the present disclosure, application, or uses.

Referring to FIG. 1, there is shown a swing weight apparatus 10 for use with a golf club 12. The apparatus 10 is ideally suited to be quickly and easily attached to a club shaft 14 of the golf club 12, adjacent to a club head 16, for the purpose of adding a controlled amount of weight to the club shaft when an individual is taking swing practice with the golf club. The additional weight helps an individual to build increased club swing speed, as well as a stronger, more fluid golf swing. The apparatus 10 also helps to strengthen a golfer's grip and arm strength. While the apparatus 10 is shown being used on an iron, it is equally well adapted to be used on a driver or fairway wood.

In FIG. 2 the apparatus 10 can be seen to include a first weight 18, a second weight 20, and a strap 22 for securing weights 18 and 20 to the club shaft 14. However, it will be appreciated that the apparatus 10 could just as easily be used with only a single weight, and thus the illustration of two weights should be understood as simply representing one embodiment of the apparatus 10. The use of two weights, however, enables the apparatus 10 to be more easily tailored to golfers of different strengths, as will be explained more fully in the following paragraphs.

Referring further to FIGS. 2 and 3, each of the weights 18 and 20 has an arcuate shape when viewed end-wise. The weights 18 and 20 may be formed from steel, lead or any other suitable material. An inner surface 18*a* of the first weight 18 may include a first resilient, non-slip material layer 24. The second weight 20 has an inner surface 20*a* that may include a second resilient, non-slip material layer 26. The resilient, non-slip material layers 24 and 26 may each be comprised of neoprene or any other suitable material, for example rubber, that has a non-slip texture or quality, and that preferably is slightly resilient or compressible. The material layers 24 and 26 are also preferably shaped in accordance with the curvatures of the weights 18 and 20 such that they can each more positively engage with the outer surface of the club shaft 14. The first weight 18 also includes a pair of adjacent apertures 28, while the second weight 20 (FIG. 3) includes a pair of adjacent apertures 30. The apertures 28 and 30 essentially extend completely through their respective weights 18 and 20, as well as completely through their respective material layers 24 and 26. The apertures 28 and 30 essentially form slots that are dimensioned to enable the strap 22 to be looped therethrough.

Referring further to FIG. 2, the strap 22 includes a first end 32 that includes a terminal end permanently secured (such as by sewing) around a loop element 34, which may be comprised of any suitable strong material, for example metal or plastic. The first end 32 thus cannot be separated from the loop element 34. The first end 32 also may include a first section of hook and loop type fastener material 36 secured thereto, while a second end 38 may include a second section of hook and loop type fastener material 40 secured thereto, and a stop component 39 fixedly secured to the second end 38. The stop component may be formed by a button clasp or any other like element, provided it has a thickness that will not permit the second end 38 of the strap 22, with the stop component 39 secured thereto, to be pulled through the loop element 34. Preferably the stop component 39 is formed from metal and secured such as by a rivet or other like means. The hook and loop type fastener materials 36 and 40 may comprise VELCRO® hook and loop type fastener material or any other suitable form of fastener material that effectively secures the two ends 32 and 38 together, but which can still be separated with a moderate of effort by the individual without the need for external tools.

The fastener materials 36 and 40 are disposed on opposite surfaces of the strap 22 so that they may engage one another as the second end 38 of the strap is wrapped over the first end 32. Preferably the length of the second section of hook and loop fastener material 40 is long enough to provide a degree of adjustability when tightening the strap 22 around the club shaft 14 and weights 18 and 20. In one embodiment the second end 38 of the strap may be formed by a stretchable material, such as an elastic fabric, while the first end 32 may be formed by a non-stretchable material. The two ends 32 and 38 may be secured by stitching or any suitable means, such as at dashed line 42. Using a stretchable material to form the second end 38 of the strap 22 would provide the strap with an even greater ability to adjust and accommodate different numbers of weights. This feature will be described further in the following paragraphs.

The manner that the weights 18 and 20 are secured to the strap 22, and the use of the stop component 39, provides a very significant safety feature in that the weights cannot inadvertently separate from the strap while swinging the golf club 12 with the apparatus 10 attached thereto. This is so even if the strap 22 is not holding the weights 18 and 20 perfectly tightly to the club shaft 14 during a swing of the golf club 12 (such as if a little excess slack is present in the strap 22). The stop component 39 positively prevents the strap 22 from slipping out through the apertures 38 and 40 while the golf club 12 is being swung with the apparatus 10 attached thereto. Thus, in no instance would the weights 18 and 20 be able to slide off the strap 22 during a swing. The length of the strap 22 may further be selected such that even when the first and second ends 32 and 38 are not coupled to each other, the amount of slack in the strap 22 does not allow the apparatus to be readily pulled over the club head 16, but still is sufficient to enable the apparatus 10 to be easily manipulated into place over the club shaft 14. The appropriate length selected for the strap 22 will also depend in part on the thickness of the weight(s) employed with the apparatus 10.

Referring further to FIGS. 1 and 2, in operation the apparatus 10 is secured to the club shaft 14 by sliding it over the handle end 44 while the second end 38 of the strap is free from the first end 32 and slack is present in the strap. The apparatus 10 may be positioned at any point along the length of the club shaft 14, but in most instances will typically be positioned closely adjacent the club head 16. Once positioned at the desired spot on the club shaft 14 the strap 22 is tightened and the second end 38 is pressed down over the first end 32. The two fastener materials 36 and 40 engage to securely clamp the weights 18 and 20 to the club shaft 14. Since the strap 22 provides a degree of adjustability in the clamping of the weights 18 and 20 by virtue of the lengths of the fastener materials 36 and 40, the apparatus 10 may be secured at various positions on the club shaft 14 to provide varying degrees of effective weight to the club head 16. The resilient, non-slip material layers 24 and 26 help to prevent slippage of the apparatus 10 along the club shaft 14 during a swing.

Referring now to FIG. 4, an end view of an apparatus 100 in accordance with another embodiment of the present disclosure is shown. The apparatus 100 in this embodiment is identical to the apparatus 10 with the exception that three weights 102,104 and 106 are secured via strap 108 around the club shaft 14. Loop element 110 and stop component 112 are identical to components 34 and 39. The construction of the weights 102, 104 and 106 is identical to the weights 18 and 20 described above. As a further option, one of the weights, for example weight 106, could include a pair of facing hook or tongue portions 114, as shown for weight 106' in FIG. 5, rather than a pair of adjacent apertures, to enable it to be completely separated from the strap 108. However, the spacing of the tongue portions 114 provide only a very narrow slot 116 with an opening that is just wide enough to manipulate the strap 108 into, but still narrow enough to prevent the weight 106 from slipping off the strap 106 while swinging the club 12 with the apparatus 100 clamped thereto. Weight 106' is therefore identical in construction to weight 106, as well as weights 18 and 20, with the exception that It includes the slot 116 instead of a pair of apertures (such as apertures 28 and 30 shown in FIG. 2). It will also be appreciated that various other structural designs could be implemented to provide a weight that is securely affixable to the strap 108, but still easily detachable therefrom without the need for external tools. The use of a removable third weight enables the overall weight of the apparatus 100 to be tailored to meet the practice needs of an even wider range of golfers of varying sizes and strengths.

Referring now to FIG. 6, another embodiment of a weight 200 is shown that includes a cutout 202. The cutout 202 is shaped so that it can function as a bottle cap remover. The weight 200 may otherwise be identical in construction to weights 18 and 20.

The present disclosure thus provides a plurality of different embodiments of a swing weight apparatus that are especially well suited for use with a golf club to increase the effective club head weight of the golf club. The various embodiments disclosed herein are all quickly and easily attachable to a club shaft without the need for screwdrivers, pliers or any other external tools. The various embodiments can thus all be quickly and easily detached without the need for any external tools. Importantly, once secured to the club shaft, the various embodiments of the apparatus cannot come inadvertently free from the strap 22 or 108 while swinging the club 12. Moreover, the various embodiments of the apparatus are all compact and can be easily stored in a golf bag. The various embodiments are all highly cost effective to manufacture and durable.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A golf club swing weight apparatus comprising:

a weight having an aperture formed therein;

a strap having a length sufficient to extend through the aperture, around the weight and around a club shaft of a golf club so that the strap secures the weight to the club shaft;

said strap including a loop element affixed to a first end thereof, and a first hook and loop type fastener material at said first end, a second end of said strap including a safety stop component fixedly secured to said strap, said safety stop component having dimensions such that said safety stop component prevents said second end from being completely pulled through said loop element; and said second end including a second hook and loop type fastener material secured at said second end that is engageable with said first hook and loop type fastener material; and wherein when said first and second hook and loop type fastener materials are engaged around said weight and said club shaft, said weight is securely held to said club shaft, and said safety stop component and said loop element cooperatively prevent said weight and said strap from being inadvertently released from said club shaft while swinging said golf club, and said safety stop component prevents the second end of the strap from being drawn through the loon element even if the first hook and loop type fastener material loop becomes detached from the second hook and loop type fastener material while swinging the golf club, to thus prevent releasing said weight from said club shaft while swinging the golf club.

2. The apparatus of claim 1, wherein said weight includes a pair of said apertures disposed adjacent to one another, through which said strap extends.

3. The apparatus of claim 1, wherein said strap includes a stretchable portion and a non-stretchable portion, with said second hook and loop type fastener material being secured to said stretchable portion.

4. The apparatus of claim 1, wherein said weight includes a slip resistant, resilient material on an inner surface thereof that contacts said club shaft when said weight is positioned against said club shaft and tends to prevent slippage of said weight on said club shaft while swinging said golf club.

5. The apparatus of claim 4, wherein said slip resistant, resilient material comprises a layer of neoprene.

6. The apparatus of claim 1, further comprising an additional weight having an aperture, said weight and said additional weight adapted to be secured by said strap securely to said club shaft.

7. The apparatus of claim 1, wherein said weight comprises an arcuate shape.

8. The apparatus of claim 1, wherein said weight includes a cutout section adapted to function as a bottle cap opener.

9. A golf club swing weight apparatus comprising:

a first weight having a first pair of apertures formed therein, and adapted to be secured against a club shaft of a golf club;

a second weight having a second pair of apertures formed therein and adapted to be secured around said club shaft of said golf club;

a strap having a length sufficient to extend through the first and second pairs of apertures, and around the first and second weights when the first and second weights are positioned adjacent one another on said club shaft, to thus secure said first and second weights to the club shaft;

said strap including a loop element affixed to a first end thereof, and a first hook and loop type fastener material at said first end, a second end of said strap including a safety stop component fixedly secured to said strap, said safety stop component having dimensions such that said safety stop component prevents said second end from being completely pulled through said loop element; and said second end including a second hook and loop type fastener material secured at said end that is engageable with said first hook and loop type fastener material; and wherein when said first and second hook and loop type fastener materials are engaged with each other, with said strap extending around said weights and said club shaft, said weights are securely held to said club shaft, and said safety stop component and said loop element cooperatively prevent said weights and said strap from being inadvertently released from said club shaft while swinging said golf club even if said first and second loop type fastener materials become detached from one another while swinging said golf club.

10. The apparatus of claim 9, wherein said strap includes a stretchable portion and a non-stretchable portion, with said second hook and loop type fastener material being secured to said stretchable portion.

11. The apparatus of claim 9, wherein said weights each include a slip resistant, resilient material on an inner surface thereof that contacts said club shaft when said weights are positioned against said club shaft and tends to prevent slippage of said weights on said club shaft while swinging said golf club.

12. The apparatus of claim 11, wherein said slip resistant, resilient material comprises neoprene.

13. The apparatus of claim 9, wherein each of said weights comprises an arcuate shape.

14. The apparatus of claim 9, wherein one of said weights includes a cutout section adapted to function as a bottle cap removal tool.

15. The apparatus of claim 9, further comprising a third weight adapted to be positioned against said club shaft and to engage with a portion of said strap, such that said third weight is also held securely to said club shaft while swinging said golf club.

16. A golf club swing weight apparatus comprising:

a first arcuately shaped weight having a first pair of apertures formed therein, and adapted to be secured against a club shaft of a golf club;

a second arcuately shaped weight having a second pair of apertures formed therein and adapted to be secured around said club shaft of said golf club;

a strap having a length sufficient to extend through the first and second pairs of apertures, and around the first and second arcuately shaped weights when the first and second arcuately shaped weights are positioned adjacent one another on said club shaft, to thus secure said first and second arcuately shaped weights to the club shaft;

said strap including a loop element affixed to a first end thereof, and a first hook and loop type fastener material at said first end, a second end of said strap including a safety stop component fixedly secured to said strap, said safety stop component having dimensions such that said safety stop component prevents said second end from being completely pulled through said loop element; and said second end including a second hoop hook and loop type fastener material secured at said second end that is engageable with said first hook and loop type fastener material so that said strap secures said first and second arcuately shaped weights to said club shaft; and wherein when said first and second hook and loop type fastener materials are engaged with each other, and said strap extends around said arcuately shaped weights and said club shaft, said arcuately shaped weights are securely held to said club shaft, and said safety stop component and said loop element prevent said arcuately shaped weights and said strap from being inadvertently released from said club shaft while swinging said golf club in the event said first and second hook and loon type fastening materials become detached from one another while swinging said golf club.

17. The apparatus of claim 16, wherein at least one of said weights includes a cutout section adapted to function as a bottle cap removal tool.

18. The apparatus of claim 16, wherein each of said weights includes an inner surface having a layer of neoprene.

19. The apparatus of claim 16, further comprising a third, arcuately shaped weight having a third pair of apertures, said strap adapted to extend through said third pair of apertures so that said third arcuately shaped weight is held against said club shaft adjacent said first and second arcuately shaped weights.

20. The apparatus 16, wherein said strap includes a stretchable portion and a non-stretchable portion, with said stretchable portion including said second hook and loop type fastener material.

* * * * *